US006382297B1

(12) United States Patent
Takizawa et al.

(10) Patent No.: US 6,382,297 B1
(45) Date of Patent: May 7, 2002

(54) ENGAGING DEVICE

(75) Inventors: Toshiaki Takizawa; Yoshinobu Takahashi, both of Toyama-ken (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 09/695,914

(22) Filed: Oct. 26, 2000

(30) Foreign Application Priority Data

Oct. 27, 1999 (JP) ..... 11-305329

(51) Int. Cl.[7] ..... A47H 1/00
(52) U.S. Cl. ..... 160/330; 24/306; 24/716
(58) Field of Search ..... 160/330, 345, 160/348, 84.01, 368.1, 123, DIG. 7; 24/306, 442, 452, 716, 446; 16/87.2, 87.4 R

(56) References Cited

U.S. PATENT DOCUMENTS 3,196,511 A * 7/1965 Kintner ..... 160/345 X
3,338,291 A * 8/1967 Kintner ..... 160/348
5,109,912 A * 5/1992 Gary ..... 160/330
5,520,983 A * 5/1996 Yamamoto et al. ..... 160/345 X
5,544,387 A * 8/1996 Yamamoto et al. ..... 24/716 X
5,586,595 A * 12/1996 Takizawa et al. ..... 160/330
5,615,461 A * 4/1997 Tominaga et al. ..... 160/330 X

* cited by examiner

*Primary Examiner*—David M. Purol
(74) *Attorney, Agent, or Firm*—Finnegan, Henderson, Farabow, Garrett & Dunner, L.L.P.

(57) ABSTRACT

This invention provides various kinds of engaging devices made of thermoplastic resin material which has an excellent productivity and secures an easiness in handling upon engagement or disengagement and in which breaking of hook element at each end is prevented and the hook element is never pierced into the finger. More specifically, the invention provides an engaging device having a plurality of hook elements disposed in plural rows on a surface of a substrate so as to engage with an engaging portion of a mating member having a plurality of loop elements on a surface thereof. Projections risen substantially vertically from a surface of the substrate are formed integrally therewith so as to secure protection function and backup function.

7 Claims, 8 Drawing Sheets

ENGAGING DEVICE

BACKGROUND OF THE INVENTION

1. Field of the Invention

The present invention relates to a cloth hanging engaging device which easily connects a curtain rail to various types of screens such as a curtain, an interior material engaging device which is disposed between a mounting body such as indoor ceiling, floor, panel material and the like and a sheet material such as mat, carpet, wall material, ceiling material, dash board and the like to fix the mounting body and the sheet material by engagement, synthetic resin engaging device for fixing threads or the like and an engaging device which can substitute for clothes buttons.

2. Description of the Related Art

A cloth hanging engaging device has been disclosed in for example, Japanese Patent Laid-Open Publication No. 4-104909, in which, in order to improve efficiency in operation for replacing a curtain or screen, the cloth hanging engaging device is disposed between a runner to be attached to a curtain rail or guide bar and a curtain or the like so as to facilitate the attachment and detachment of the curtains or the like. This cloth hanging engaging device has a plurality of hook elements in plural rows on a surface of a plate-like substrate which are formed integrally therewith and a hook-shaped hanger portion is formed of the same synthetic resin material integrally on a top end of the substrate so as to be hooked on the aforementioned runner. The hook elements are arranged vertically and a plurality of rows thereof are disposed in the width direction from the right to the left. The hooking direction of the hook elements in the same hook row is the same. The hook elements of all the hook rows which are adjacent to each other may be directed to the same direction or part of the hook elements may be directed to opposite direction. This kind of the engaging device secures an engaging strength by directing the hooking direction thereof in most hook rows upward as shown in FIG. 5 because the curtain is supported while it hangs downward.

Various kinds of interior materials are attached to, for example, automobile ceiling, floor, door panel portion or house's wall portion, ceiling, floor and the like. A surface fastener is used for such an attachment. Although conventionally, ultrasonic fusion, pressure-sensitive welding and the like are used to fix a male/female engaging device of the surface fastener to a mounting body or interior material, such methods have deficiency in durability and fixing strength. Therefore, interior material fixing engaging device having a post-like protrusion with two-wing elastic engaging portions composed of a pair of right and left wing pieces on its tip provided on a rear surface of the plate-like substrate so that it protrudes therefrom, and a multiplicity of the hook elements are formed of synthetic resin. Then, the elastic engaging portions are elastically deformed and inserted into a hole provided in the mounting body. Using an elastic restoration of the same engaging portion, front and rear surfaces of the mounting body are nipped and fixed by the substrate and engaging portion.

Such interior material fixing engaging devices have been disclosed in, for example, Japanese Patent Publication No. 51-651, Japanese Utility Model publication No. 54-26089, and Japanese Utility Model Laid-Open Publication No. 57-31250, indicating that this is used often for interior construction of houses as well as automobile. Recently, use of the aforementioned elastic engaging portion as a curtain rail runner has been proposed in for example, Japanese Utility Model Laid-Open Publication No. 3-21285. In such a kind of the interior material engaging device, usually, to avoid generation of directivity in engaging strength, the surface of a substrate is divided to plural sections and a plurality of hook elements are disposed in each section. The hooking direction of the hook elements arranged in the same row is set to be the same and the hooking directions are set opposite between adjacent hook rows. Then, the hooking directions are perpendicular to each other between adjacent sections.

As this kind of the engaging device, for example, string length adjusting engaging device applicable for loop tie, opening tightening device for various bags, or hem tightening device of various jumpers, or opening/closing engaging device for clothes substituting for ordinary buttons are used as well as the aforementioned engaging device. These engaging devices each have a plurality of hook elements made of synthetic resin on the substrate surface made of the same synthetic resin having any shape.

Any of the aforementioned hook elements formed on the substrate surface of each of these engaging devices has the same hooking direction in the same hook row. On the other hand, for these kinds of the engaging devices, in order to secure a sufficient engaging strength, the amount of plasticizing material to be added to synthetic resin which is composition material is set lower than an engaging device in which an ordinary elasticity is demanded. Therefore, brittleness increases although some extent of high rigidity is secured. Thus, in case where the hook element disposed at the most outer end of a hook row is directed inward of the hook row, if an external force directed outward is applied to the hook element when the hook element at the most outer end portion engages with the mating loop element or the engaging device is operated by holding with the finger so as to attach it, the engaging device may be deformed largely. At this time, there is nothing that backs up the same hook element and this hook element is located near an edge of the substrate, therefore this hook element often reaches a breaking point so that it is broken.

Particularly, in case of the aforementioned cloth hanging engaging device, most of the curtain weight is supported by the hook elements disposed at a lower end of the engaging device so that a larger load is applied as compared to the other hook elements. As a result, fatigue is increased with a passage of time if the engagement/disengagement is repeated. For example, when it is intended to separate the curtain or the like from its top end, the hook elements located at a second tier from a bottom as well as the hook elements disposed at the bottom edge are likely to be broken. This is because there are no hook elements or substrate which backs up the hook elements in a bending direction located at the first and second tiers disposed at the bottom edge when the curtain or the like is separated. Thus, they are bent more largely as compared to the hook elements disposed upward thereof so that fatigue is increased as well as the aforementioned brittleness, thereby leading to breaking. The same thing can be said for the above described various kinds of the engaging devices also.

According to, for example, Japanese Patent Laid-Open Publication No. 7-155221 (U.S. Pat. No. 5,615,461), it has been proposed that the hooking direction of all the hook elements disposed on the peripheral portion of the engaging device or at least those located at the most outer end thereof are directed outward. For example, if it is intended to separate the curtain attached to the engaging device downward from its top end, the hooking direction of all the hook elements located at the bottom end of the engaging device coincide with the separation direction, so that the separation can be achieved very smoothly. Further, no unnecessary force is applied to the hook elements disposed at the lower end thereby ensuring a long period use.

Even if the curtain load is applied to hook elements located above the bottom end of the engaging device and having upward hooking direction, the backup function is exerted because hook elements whose hooking direction is directed downward exist below the aforementioned hook elements. Consequently, they are not deformed largely and even if the engagement is repeated, the fatigue is not increased and therefore, they bear a long period use and are not broken. Further, a force is applied in various directions to the curtain portion attached to the bottom end of the same engaging device. For example, if an external force is applied, to the curtain, in such a direction to separate from the bottom end of the engaging device, a force resisting that external force is exerted because the hooking direction of the hook elements located at the bottom end is directed downward. Consequently, they are not released easily so that the curtain becomes unlikely to be released from the engaging device.

Although in the engaging device disclosed in the above Japanese Patent Laid-Open Publication No. 7-155221, a damage due to breaking of the hook element disposed at the peripheral portion of the substrate is avoided, it has been made evident that a problem peculiar to this kind of the engaging device arises when the hooking direction of the hook elements disposed at the peripheral portion of the substrate of the hook row is directed outward as described above.

That is, as described above, in this kind of the engaging device, rigidity of the material is raised to increase the engaging strength. On the other hand, a hook tip of the aforementioned hook element is larger as compared to a molded surface fastener having an excellent flexibility, which is an ordinary simple engaging device for combining different cloths. However, as for the aforementioned thread fixing engaging device, the dimension of the hook tip is 0.3 mm in its lateral width as viewed from front and a height of the entire hook from the surface of the substrate is 0.9 mm, and a height of a bottom face of the hook tip from the surface of the substrate is 0.5 mm. Further, the hook element has a curved shape whose thickness decreases gradually from a top end of a stem thereof to the hook tip which is directed toward the surface of the substrate.

Thus, the hook tip is tapered along a distance of only 0.4 mm, and therefore, a tip of each hook element has sharpness like a pin. Therefore, when this engaging device is handled for engagement or disengagement, not only pain is felt as the finger touches the hook element, but also the finger may be pierced by the hook tip and injured. In this point, this kind of the hook element lacks the safety. Further, there is a danger that the hook element may be broken and stick in the finger.

SUMMARY OF THE INVENTION

The present invention has been achieved in views of the above described problems and an object of the invention is to provide an engaging device which is capable of utilizing advantages of an engaging device made of synthetic resin, protecting the hook elements disposed at the edge of the engaging device and securing the safety when the engaging device is operated.

To achieve the above object, according to the invention, there is provided an engaging device having a plurality of hook elements disposed in plural rows on a surface of a substrate so as to engage with an engaging portion of a mating member having a plurality of loop elements on a surface thereof, wherein projections projected substantially vertically from the substrate are disposed at at least one of outermost ends of each of the hook rows disposed on the engaging device so as to be formed integrally with the engaging device.

That is, when the projection and the hook element are disposed such that the projection and the hook tip of the hook element oppose each other at the most front or most rear end of the hook row, even if the finger is moved toward a hook end of the hook element, the finger never touches the hook tip and therefore it is never injured because the projection functions as a blocking member for the hook element opposing the projection. On the other hand, in case where the projection is disposed in an end opposite to the direction of the hook element, even if a mating loop element engages with the hook element disposed in front of the projection, for example, and then the hook element is pulled backward by the same loop element so that it may be bent largely, the projection functions as a backup member so that when the bent hook element comes into contact with the projection, it is never deformed further. Consequently, the same hook element is never broken. Further, if the projections are disposed on both the ends of the hook row, the above described respective functions are exerted, so that the finger is never pierced and injured by the hook element disposed at the most front end of each hook row or the hook element disposed at the most rear end thereof is not broken.

Preferably, a height of the projection from the surface of the substrate is set higher than the position of a bottom face of a front end of the hook element. In the present invention, a lower limit height of the projection when the above-described function is secured is specified. That is, this height is a height which prevents the finger from touching the hook end of the hook element in the hook row and allows the entire hook element to be bent backward in an allowable limit. Further, this height allows the hook element to be deformed enough for the mating engaging loop element to be removed from the hook element. Because of the above described function and dimensions of the projection, the upper limit height of the projection is desired to be an upper limit height of the hook element.

The present invention specifies typical kinds of the engaging device. In the meantime, there are other engaging devices like, for example, an engaging device for attaching a grinding cloth to a grinding machine.

The mating member may be a hanging cloth such as a curtain and screen, and the engaging device has a plurality of hook rows provided on the surface of the substrate and further has a hook-like hooking portion provided at an upper end of the substrate through a neck portion. The mating member may be a plate-like interior material and the engaging device has a plurality of hook rows provided on the surface of the flat plate-like substrate having some degree of rigidity and further includes a post-like protrusion having two-wing shaped elastic engaging portion at a top end thereof provided in the center of a back face of the substrate, so that the elastic engaging portion is inserted into an engaging hole formed in a mounting body and fixed to the mounting body by engagement.

The mating member may be clothes or various kinds of bags having a pair of opposing opening/closing edge portions, and the substrate is attached to one of the opening/closing edge portions of the clothes or the various kinds of bags and has a plurality of hook rows on the surface thereof.

The mating member may be the clothes or the various kinds of bags and the substrate is disposed in the vicinity of an opening of the clothes or the various kinds of bags and having a plurality of hook rows provided on the surface thereof, while the substrate has an insertion hole through which a thread is to be inserted and thread engaging/disengaging means for engaging or disengaging the thread inserted through the thread insertion hole.

DESCRIPTION OF THE PREFERRED EMBODIMENTS

First, a curtain hanging engaging device of a typical embodiment of the present invention will be described with reference to the accompanying drawings. It is understood easily that the engaging device of the present invention is not restricted to examples shown in the following drawings from the fact that as described in the aforementioned Japanese Patent Laid-Open Publication No.HEI7-155221, a region to be formed as a flat portion between hook rows and a hooking direction of the hook row can be changed in diversified ways depending on necessity.

Figure 1:
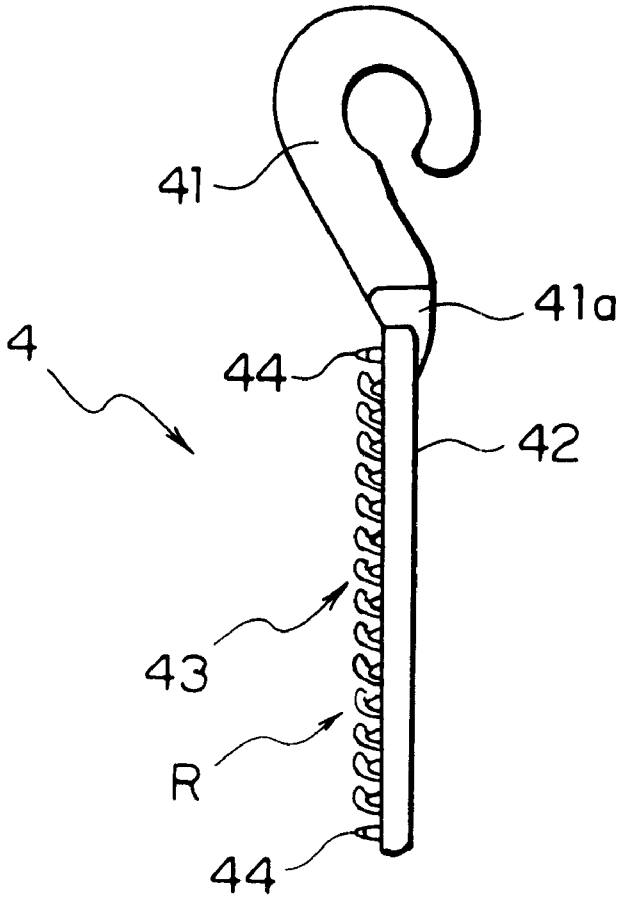
FIG. 1 is a side view of an engaging device for a curtain according to a typical embodiment of the present invention.

According to the embodiment shown in FIG. 1, a curtain hanging engaging device 4 of the present invention comprises a hooking portion 41, which is hooked on a ring of a curtain runner, and a plate-like substrate 42, which is connected to the hooking portion 41 through a neck portion 41*a*. A plurality of hook elements 43 stand on the surface of the substrate 42. The plurality of hook elements 43 are disposed so as to form a row R extending vertically and a plurality of the rows are arranged in the right and left direction. Totally nine hook rows R, for example, may be disposed, of which five rows are disposed in the center and two rows are disposed on each of the right and left sides of those in the center with a predetermined interval. In this example, the directions of the hook elements 43 of the aforementioned five rows in the center are set upward while the directions of the hook elements 43 of the two hook rows R on each of the right and left sides are set upward and downward. However, the present invention is not restricted to this example.

Figure 2:
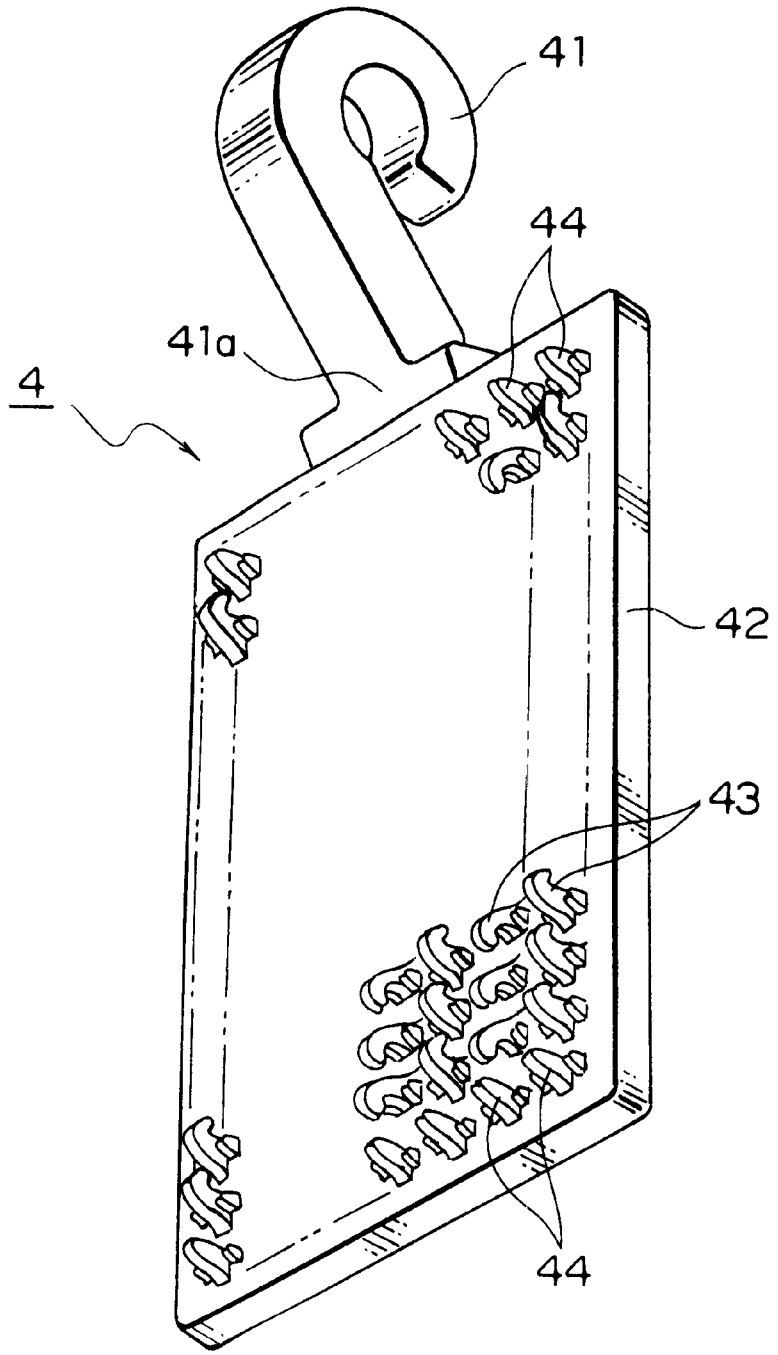
FIG. 2 is a perspective view showing the engaging device of FIG. 1 in enlargement.

A feature portion of the curtain hanging engaging device 4 of the present invention is an projection 44 disposed on upper and lower ends of each hook row R. The projection 44 is disposed in a position where as shown in FIG. 2, the hook elements disposed on both the upper and lower ends of the conventional hook row R are risen. According to the illustrated embodiment, the aforementioned projections 44 are disposed on the upper and lower ends of each hook row R. The projections 44 are also formed integrally with the other component members of the curtain hanging engaging device 4. In this embodiment, the projection 44 has a height from the substrate higher than the position of a bottom face of a front end of the hook element.

The engaging device of the present invention is usually formed by injection molding in the same manner as the molded surface fastener disclosed in the aforementioned Japanese Patent Laid-Open Publication No. 7-155221. The projection 44 utilizes that molding die effectively. That is, because the hook element 43 which is an engaging element is hook-shaped, hook element forming cavities cannot be formed in a single molding die for this kind of the surface fastener. Thus, an edge portion of a thin plate is cut out in a shape of part of a configuration of the hook element 43 and then, by combining the cut-out portions of the plural thin plates, a single hook element forming cavity is formed. Using this set of the thin plates, a linear hook row R comprised of plural hook elements 43 is formed along an edge portion of the aforementioned set of the thin plates.

Upon forming the projection 44, by combining the projection forming notch portions formed in the plural thin plates (not shown), the projection forming cavity having any shape can be formed in the same manner as the hook element forming cavity.

Figure 3:
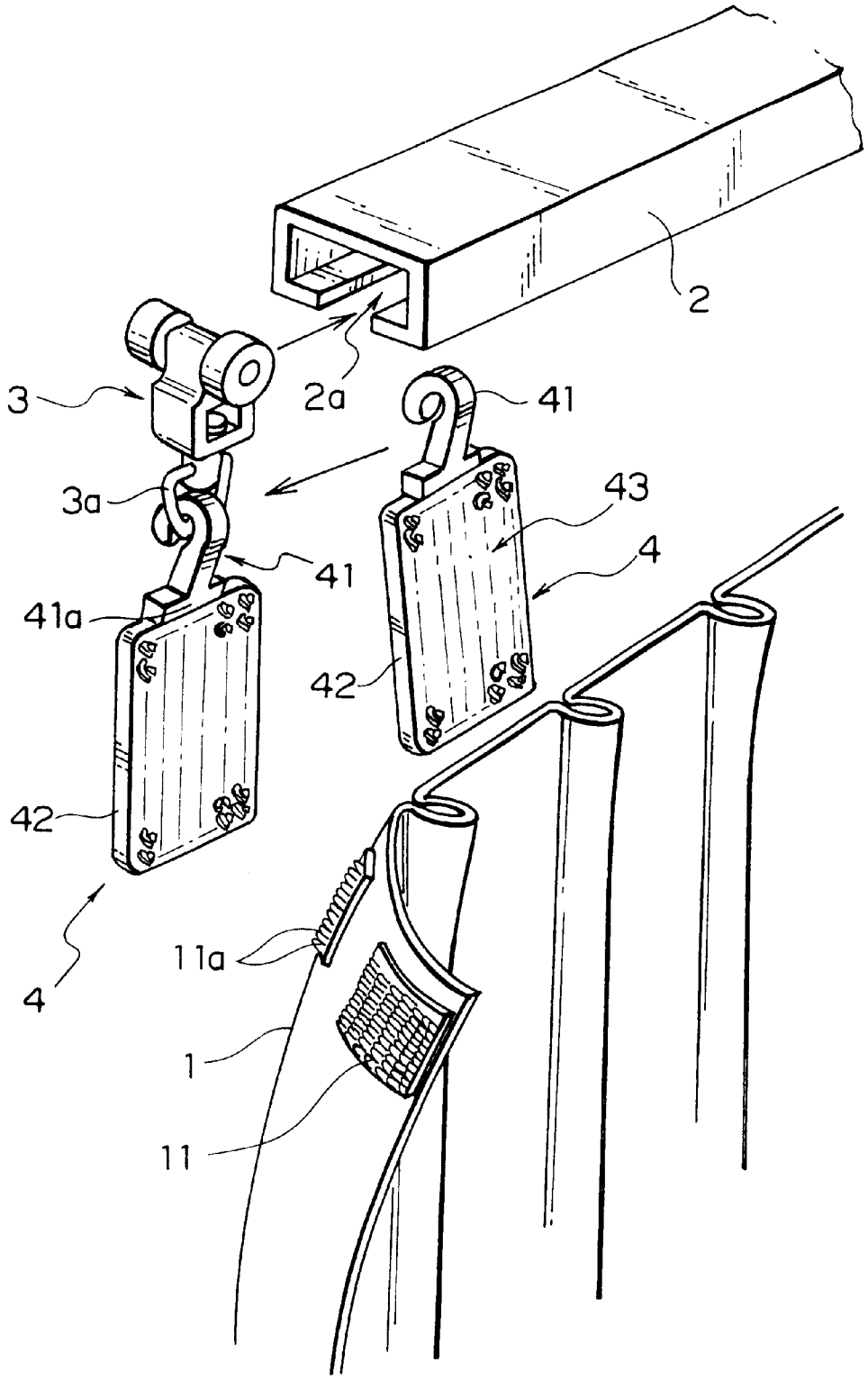
FIG. 3 is a perspective view showing a procedure for attachment of a curtain attaching portion to which the same engaging device is applied.

According to the embodiment shown in FIGS. 1 to 3, instead of the hook elements 43 disposed on both the upper and lower end portion of the plural hook rows R formed on the surface of the substrate 42, the projections 44 constituting the feature portion of the present invention are formed so as to be erected substantially at right angle from the surface of the substrate 42. FIG. 3 is a perspective view showing a curtain attaching portion with a partially disassembled state of the curtain hanging engaging device 4 having a typical structure of the present invention. Reference numeral 1 denotes a curtain, which is a kind of the screen and female surface fastener tape pieces 11 each having a multiplicity of loop elements 11*a* are attached on an upper edge of the curtain 1 at a predetermined interval. Reference numeral 2 denotes a curtain rail, which is a guide member and is composed of a long molded member having a substantially C-shaped cross section and has a slit-like opening portion 2*a* on a bottom thereof.

When hanging the curtain 1 on the curtain rail 2 using the curtain hanging engaging devices 4 of this embodiment having such a structure, first, the hooking portion 41 of the curtain hanging engaging device 4 is hooked on a ring 3*a* of a curtain runner 3 and then, by pressing an engaging surface in which the hook elements 43 and projections 44 are formed of the curtain hanging engaging device 4 to the female surface fastener tape piece 11 attached along the upper edge of the curtain 1, the same engaging device 4 is attached. In this case, it is permissible to fix the curtain hanging engaging device 4 to the female surface fastener tape piece 11 attached to the upper edge of the curtain 1 temporarily and then hook the hooking portions 41 of the curtain hanging engaging device 4 to the ring 3*a* of the curtain runner 3.

When removing the curtain hanging engaging device 4 from the curtain 1, it is intended to separate it downward from a top end thereof. At this time, a force is applied to the hook elements 43 disposed on a bottom end of the engaging device 4 in the separating direction, so that the same hook elements 43 are forced to be deformed largely backward. However, because the projections 44 stand on the rear side of the hook elements 43, when the projections 44 comes into contact with the rear face of the hook elements 43, the hook elements 43 are not bent further, so that they are prevented from being broken. That is, the projections 44 function as the backup material for the hook elements 43. As a result, the hook elements 43 are not so deformed that they are broken, and therefore, even if attachment and separation thereof are repeated, fatigue is not increased so that a long period use is ensured sufficiently.

When the curtain hanging engaging device 4 is carried and attached or detached the curtain 1 to/from the curtain rail 2 as described above, even if the finger tip comes into contact with an edge of the curtain hanging engaging device 4 and moves in a direction of a hook row R located near the edge portion, the projection 44 opposing the hook of the hook element 43 disposed at the most outer end of each hook row R restricts a motion of the finger tip as a block member, so that the hook tip of the hook element 43 is never pierced into the finger tip.

Figure 4:
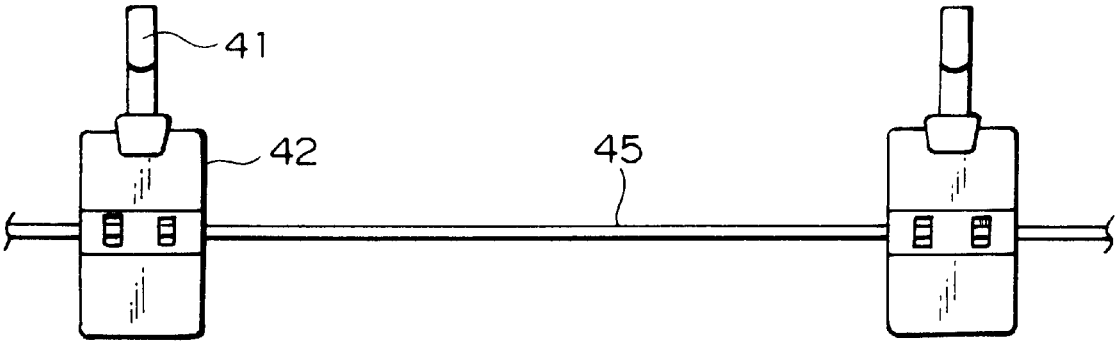
FIG. 4 is a plan view showing another example of application of the same engaging device.

FIGS. 1 to 3 show a case in which the curtain hanging engaging device 4 of the present invention is comprised of a single member. However, the present invention includes a case in which a multiplicity of the curtain hanging engaging devices 4 are provided continuously at a predetermined interval through one or more threads 45 such as threads or tapes as shown in FIG. 4. In this case also, the hooking portion 41 in each curtain hanging engaging device 4 has the same structure and the same function as the above described one.

To connect the curtain hanging engaging devices 4 to each other through a thread 45, the substrates 42 are molded continuously while they are integrated with the thread. That is, the substrate 42 is formed by injection molding while guiding and passing the thread 45 through a guide path in an injection molding die in which the forming cavity for the substrate 42 and the guide path are combined. Consequently, the continuous long thread 45 and the curtain hanging engaging devices 4 are formed integrally with each other continuously at a predetermined interval.

Figure 5:
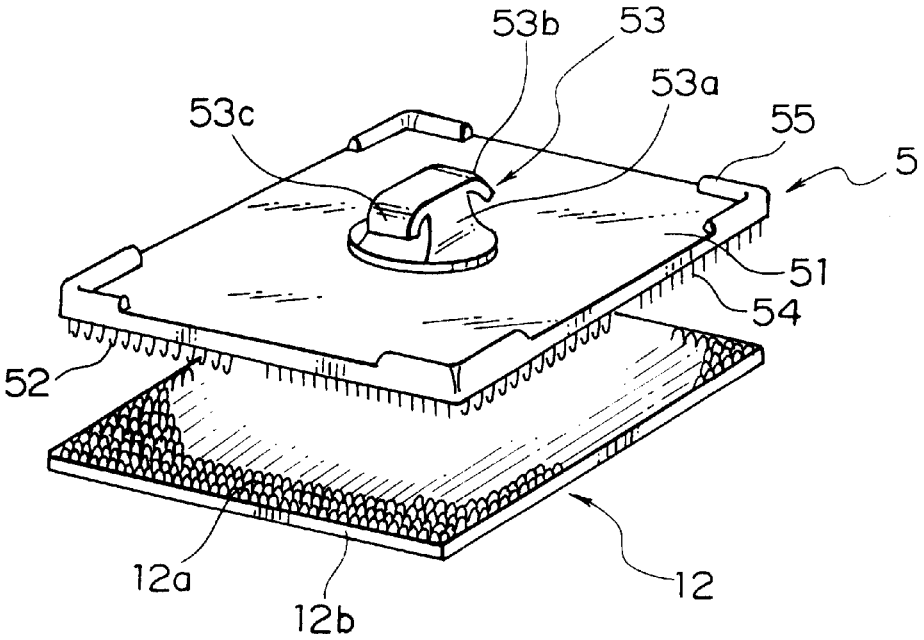
FIG. 5 is a perspective of an interior material engaging device according to a second embodiment of the present invention as viewed obliquely from above.
Figure 6:
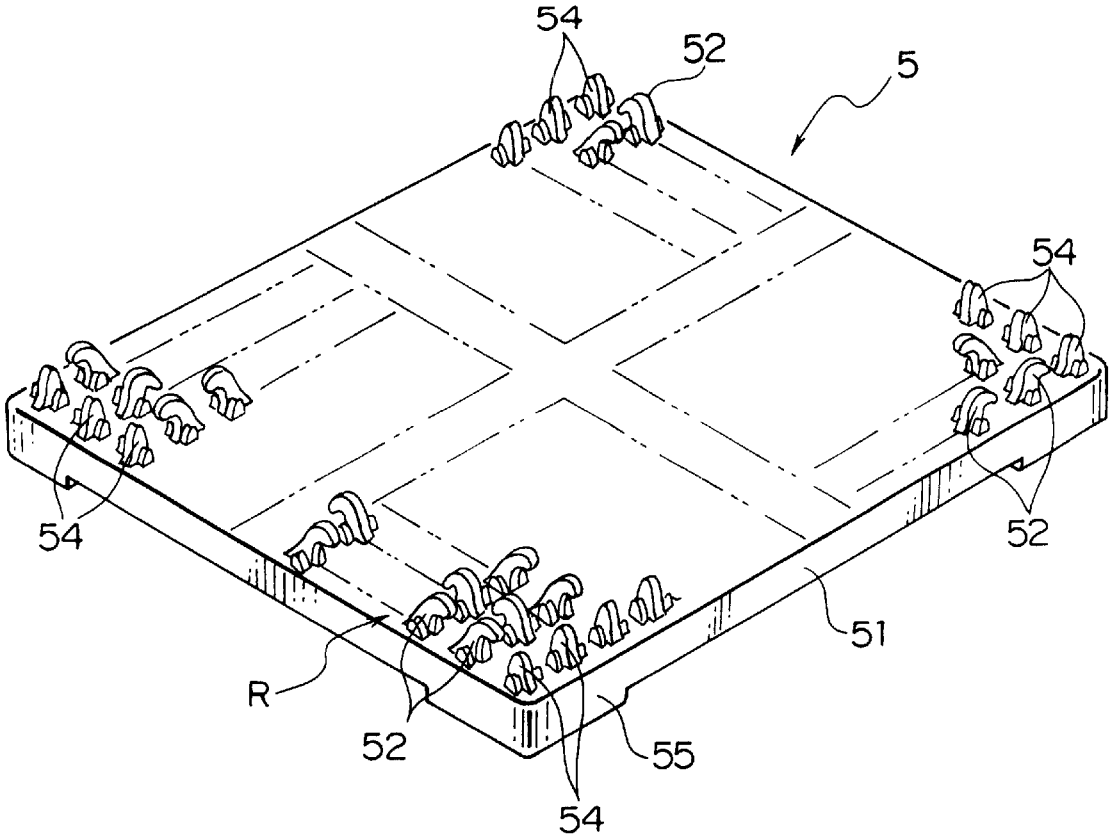
FIG. 6 is a perspective view of the engaging device of FIG. 5 as view from below.
Figure 7:
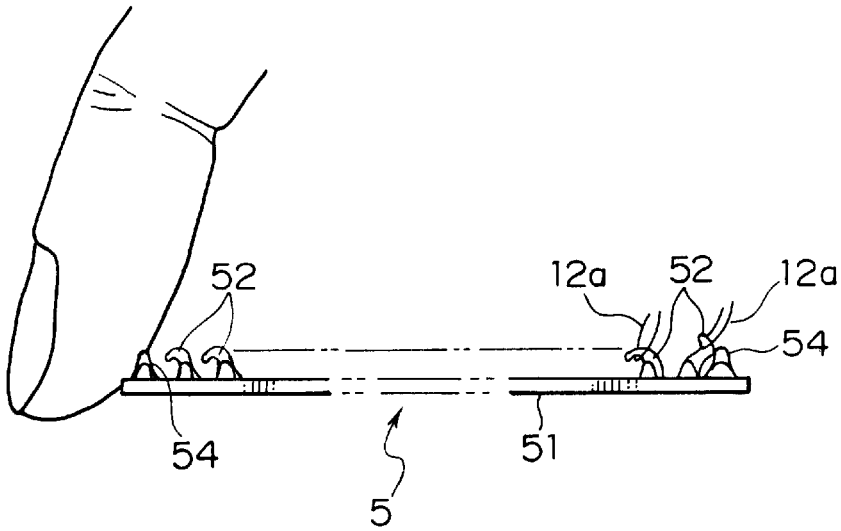
FIG. 7 is a diagram for explaining the function of the same engaging device.

Next, an automobile interior material fixing engaging device according to a second embodiment of the present invention will be described with reference to the accompanying drawings. FIG. 5 is a perspective view of the same engaging device as viewed obliquely from above, FIG. 6 is a perspective view of the engaging device as seen from below and FIG. 7 is a diagram for explaining the functions of the engaging device. Reference numeral 5 denotes a square engaging device (interior material fixing engaging device) to be fixed to an automobile interior body portion and reference numeral 12 denotes a square female engaging piece fixed to an automobile interior material (not shown). These interior material fixing engaging device 5 and female engaging piece 12 each have substrates 51 and 12*b*.

A plurality of hook elements 52 are formed on a surface of the substrate 51 of the interior material fixing engaging device 5 so as to stand thereon. A post-like protrusion 53*a* is formed integrally with the substrate 51 in the center of the other surface, the post-like protrusion having an elastic engaging portion 53 at a front end thereof and having a substantially rectangular section as viewed in plan. In the illustrated example, a surface of the aforementioned substrate 51 is divided to four sections and the hooking directions of the hook elements 52 disposed in adjacent sections are deviated by 90° with respect to each other such that they are perpendicular to each other. In each section, a plurality of the hook rows R each comprised of a multiplicity of the hook elements 52 are arranged in parallel to each other while the hooking directions of the hook elements 52 in adjacent rows are inverted to each other. Further, the hook row R is perpendicular to peripheries of the substrate 51, and instead of the hook elements 52 disposed near the peripheral portion of the substrate 51 in the same hook row R, projections 54 are formed so as to stand at substantially right angle.

In such an interior material fixing engaging device 5, an interior material (not shown) which is a mating member is supported by mainly the hook elements 52 disposed nearest the peripheries of the substrate 51. Therefore, a load is repeatedly applied to the hook elements disposed on the peripheries so that a fatigue is likely to be increased as compared to other hook elements 52, like the curtain hanging engaging device. Further, because when the aforementioned interior material is peeled from this kind of the interior material fixing engaging device 5, it is peeled gradually from a peripheral portion of the substrate 51 through a central portion thereof toward the peripheral portion of an opposite side. Therefore, when the interior material is peeled finally from the interior material fixing engaging device 5, peeling resistance in the hook element 52 located at an end of the hook row, whose hooking direction is directed from the peripheral portion of the substrate 51 to inside is strong, so that the hook element 52 nearest the outer peripheral portion of the substrate of the same hook row R is likely to be deformed largely outward and be broken.

On the contrary, according to the present invention, in all the rows of the plural hook rows R perpendicular to each peripheral portion of the substrate 51 as described above, all hook elements at the first tier along the outer peripheral portion of the substrate are projections 54 which are risen substantially vertically from the substrate 51. When an interior material (not shown) is peeled gradually from the peripheral portion of the substrate 51 through the central portion thereof toward the peripheral portion of the other side, the hook element 52 are prevented from being deformed by a backup function of the projection 54 and from being broken, even if a large peeling force at the time of ordinary operation is applied to the hook element 52 opposing the projection 54, because the projection 54 stands at the peripheral portion in the hook row R whose hooking direction is directed inward from the outer peripheral portion of the substrate as shown in FIG. 7.

If the interior material fixing engaging device 5having such a structure is used to fix the interior material to, for example, an automobile ceiling portion or door panel portion (not shown), the female engaging piece 12 is attached at a predetermined position of the back (ceiling side) of the interior material through fixing agent such as adhesive agent and the like such that a loop element 12*a* of the female engaging piece 12 faces a front face of the engaging device 5. Then, by engaging the female engaging piece 12 to the interior material fixing engaging device 5, the aforementioned interior material is fixed to the automobile ceiling portion or door panel portion.

Because a top face of the elastic engaging portion 53 of the interior material fixing engaging device 5 is formed in a tapered shape, if it is inserted into a fitting hole (not shown) formed in a body portion of the automobile or the like (not shown), elastic wing pieces 53*b* and 53*c* extended to the (not shown), elastic wing pieces 53*b* and 53*c* extended to the front and rear directions like two wings are contracted by an inner face of the fitting hole, so that when the post-like protrusion 53*a* engages the fitting hole, the aforementioned two-wing shaped elastic wing pieces 53*b* and 53*c* are restored elastically on the body portion and expanded. Then, tips of the wing pieces 53*b*, 53*c* press a top face of a peripheral portion of the fitting hole. At this time, rib-like protruded portions 55 provided on four corners of the substrate 51 are in contact with a bottom face of the body portion, so that the interior material fixing engaging device 5 is fixed to the body portion while the body portion is nipped between the elastic engaging portion 53 and the rib-like protruded portion 55.

Then, if the loop elements 12*a* of the female engaging piece 12 attached to the interior material (not shown) is pressed against the hook elements 52 of the interior material fixing engaging device 5 fixed to the body portion (not shown), both the components join each other through their entire surfaces so that the interior material is fixed to the body portion.

According to this embodiment, the rib-like protrusions 55 do not always have to be provided on the substrate 51 and further, if the shape of the substrate is square or circular, the protrusions may be provided like a block at the positions with a predetermined interval. If the shape of the substrate is triangular, it is desirable to set the protruding positions at each vertex. In these cases, even if the interior material (sheet material) is spherical as well as it is a plane, this engaging device is capable of coping with it appropriately. Further, to intensify the flexibility of the substrate itself, it is possible to form a through hole or groove portion at a desired position of the substrate.

Figure 8:
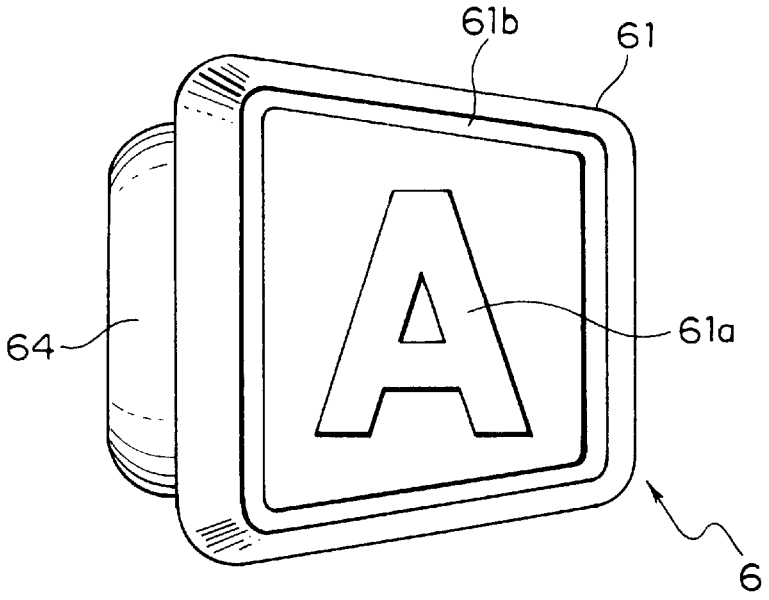
FIG. 8 is a plan view of an opening/closing engaging device to be mounted on an opening/closing edge portion of clothes and the like according to a third embodiment of the present invention.
Figure 9:
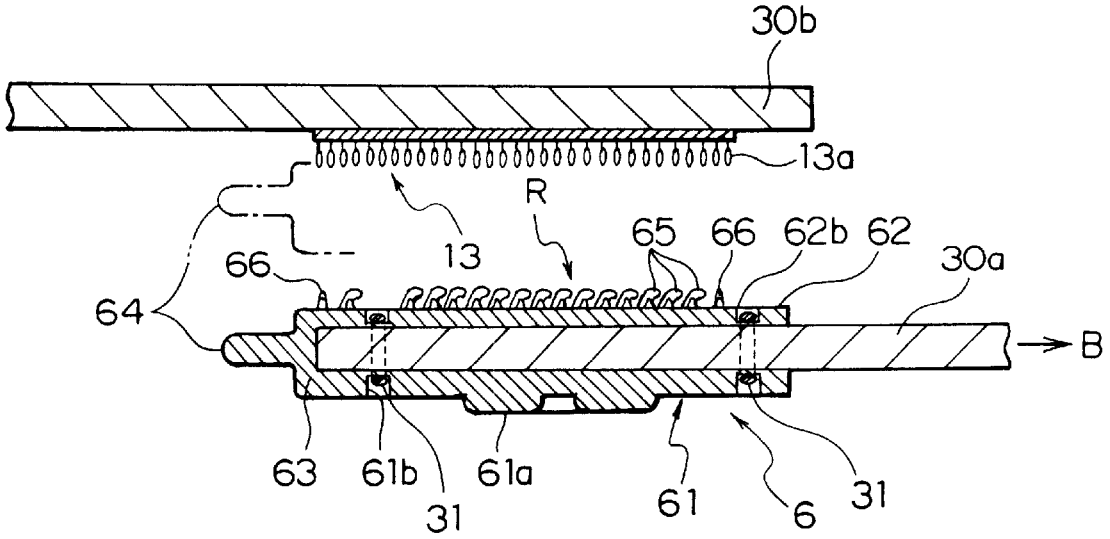
FIG. 9 is a fragmentary sectional view showing the manner of use of the same engaging device.
Figure 10:
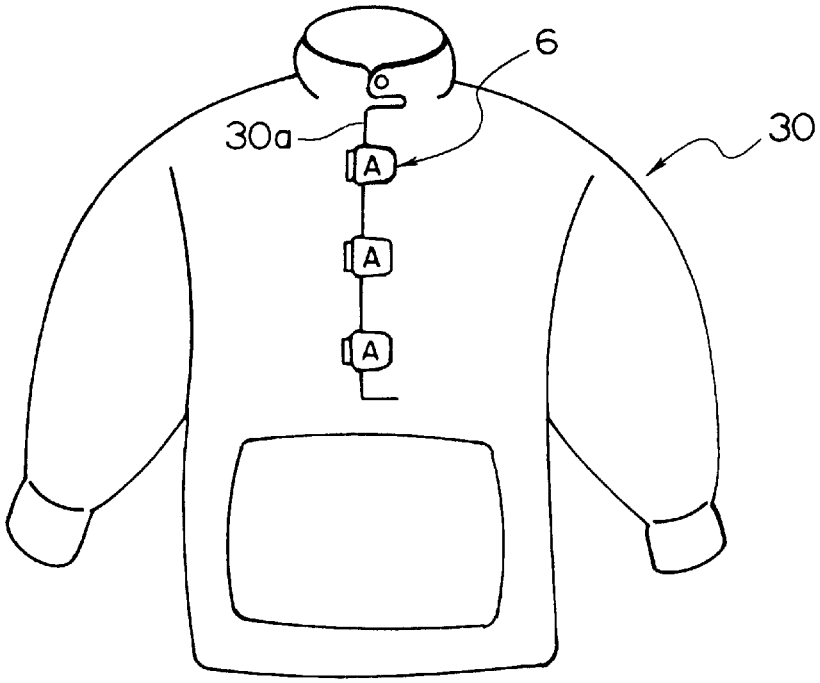
FIG. 10 is a front view showing an example of application of the same engaging device.

FIGS. 8 to 10 show an opening/closing engaging device to be attached to an opening/closing edge portion of clothes or various bags according to a third embodiment of the present invention. FIG. 8 is a view of a front face of the same opening/closing engaging device, FIG. 9 is a fragmentary sectional view showing the manner of use of the same engaging device and FIG. 10 is a front view showing an example of application of the same engaging device.

The opening/closing engaging device 6 of this embodiment is comprised of first and second flat plate portions 61 and 62 which are entirely substantially trapezoidal having chamfered four corners and both the flat plate portions 61 and 62 are connected integrally such that they are parallel to each other while bottom sides thereof are connected through a connecting portion 63. In the illustrated example, the first and second flat plate portions 61 and 62 are of the same shape, however, the first flat plate portion 61 is thicker than the second flat plate portion 62. A gripping piece 64 is provided that it is parallel to the first and second flat plate portions 61 and 62. A gap between the first and second flat plate portions 61 and 62 may be selected arbitrarily depending on the thickness of an attaching portion of clothes on which the engaging device of the present invention is to be attached. For example, by making the length of the first flat plate portion 61 exposed outside clothes or the like from the connecting portion 63 shorter than that of the second flat portion 62, a longitudinal section of the engaging device may be of J letter shape.

Various ornamental patterns 61*a* are formed on the surface of the first flat portion 61. Although this pattern is desired to be formed at the same time when the engaging device is formed, it may be formed by various welders or print after the formation. Further, continuous groove portions 61*b* and 62*b* serving as a sewing portion are formed along the peripheral portion of the surface of the first and second flat plate portions 61 and 62. Although the groove portions 61*b* and 62*b* are not necessary if the thickness of the first and second flat plate portions 61 and 62 is not an obstacle to sewing operation, it is desirable to form the groove portion 61*b* even slightly because a sewing line can be recognized.

As shown in FIG. 9, a plurality of hook elements 65 are formed on the surface of the second flat plate portion 62 to protrude in rows. In the illustrated example, all the hook protrude in rows. In the illustrated example, all the hook elements 65 are directed in the same direction. Because the respective hook elements 65 are formed such that the hooking direction thereof is set to an opposite direction to the protruding direction of the gripping piece 64, the engaging strength with a mating surface fastener piece 13 having a plurality of loop elements 13*a* becomes the strongest in a single direction which is opposite to the extending direction of the aforementioned hook elements.

In this embodiment, an projection 66 which is a feature of the present invention is protruded substantially vertically from the surface of the second flat plate portion 62 on both ends of each hook row R as shown in FIG. 9. Therefore, in this embodiment also, because the projections 66 exist on both ends of each hook row, when the engaging device 6 is attached to clothes or the like or it is engaged with the mating surface fastener piece 13, the projection 66 act as a blocking member to protect the finger from touching the hook element 65 protruded from the outermost edge of the second flat plate portion 62 with the hooking direction being set outward. Thus, the tip of the hook element 65 is never pierced into the finger tip.

Because the aforementioned projection 66 is disposed at the outermost edge in a direction opposite to the hooking direction of the same hook row, when it is intended to open device 6 of the present invention from the mating surface fastener piece 13, the hook element 65 is deformed largely in the direction to its rear face in order to release engagement between the loop element 13*a* of the mating surface fastener piece 13 and the hook element 65 opposing the projection 66 through its back.

When the opening/closing engaging device 6 of this embodiment having such a structure is attached to clothes or the like, a top front edge 30*a* of a fly portion of clothes 30 such as ski wear is placed at a predetermined position such that it is sandwiched by the first and second flat plate portions 61 and 62, with the gripping piece 64 located outside and a face from which the hook elements 65 are protruded located inside as shown in FIGS. 9 and 10. Then, this opening/closing engaging device 6 is sewed along the groove portions 61*b* and 62*b* with sewing yarns 31. In the meantime, the engaging device 6 may be bonded with adhesive agent instead of sewing. In case of attachment by bonding also, it is preferable to form the groove portions 61*b* and 62*b* for the reason which will be described later. On the other hand, the mating surface fastener piece 13 having a plurality of the loop elements 13*a* which engage or disengage from the engaging device 6 is attached on a bottom front edge 30*b* of the fly portion corresponding to the attachment position of the engaging device 6 by sewing or bonding.

If the opening/closing engaging device 6 of the present invention is pressed against the mating surface fastener 13 attached at a corresponding position, both engage with each other easily so that the fly portion shown in FIG. 9 is closed. Because according to this embodiment, the hooking direction of the hook element 65 is directed to a clothes opening direction at this time, even if a strong external force is applied in a sliding direction when the fly portion is opened, the loop element 13*a* acts in a shearing direction of the hook element 65 or in a direction in which the engaging strength becomes the strongest, so that the opening/closing engaging device 6 is not released easily. If the gripping piece 64 is gripped and the engaging device 60 is operated in the peeling direction (downward in FIG. 9) from this closing state, the flat plate portions 61 and 62 are likely to be bent along the groove portions 61*b* and 62*b* because the groove portions 61*b* and 62*b* are thinner than the other portions of the flat plate portions 61 and 62, thereby further facilitating disengagement between the hook elements 65 and the loop elements 13*a*.

Figure 11:
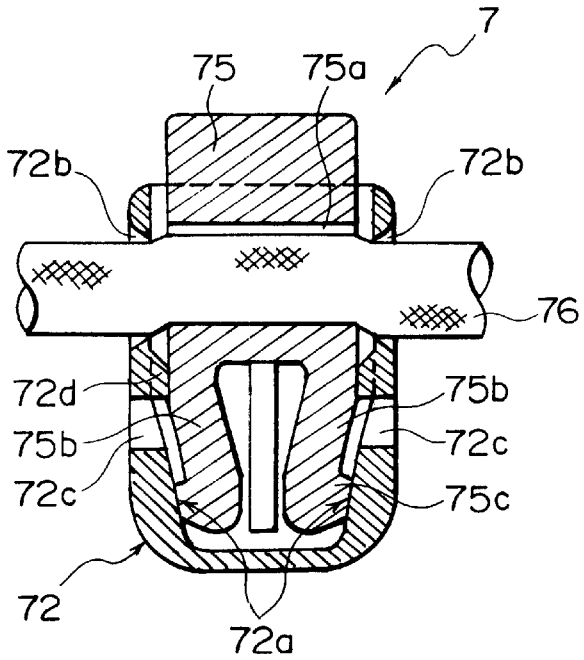
FIG. 11 is a sectional view showing an engaging device for fixing a thread in use according to a fourth embodiment of the present invention.
Figure 12:
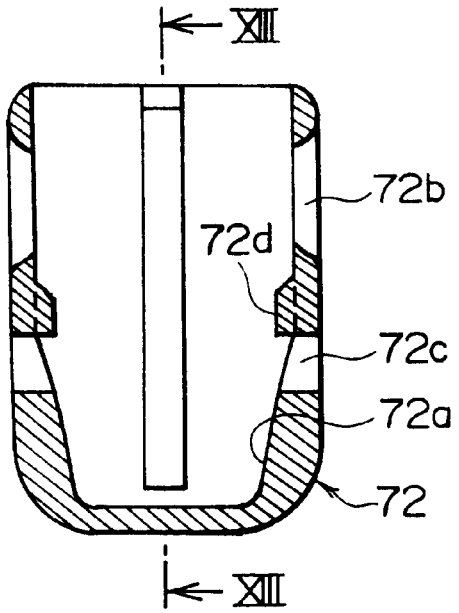
FIG. 12 is a horizontal sectional view of a socket portion of the gaging device of FIG. 11 for a thread.
Figure 13:
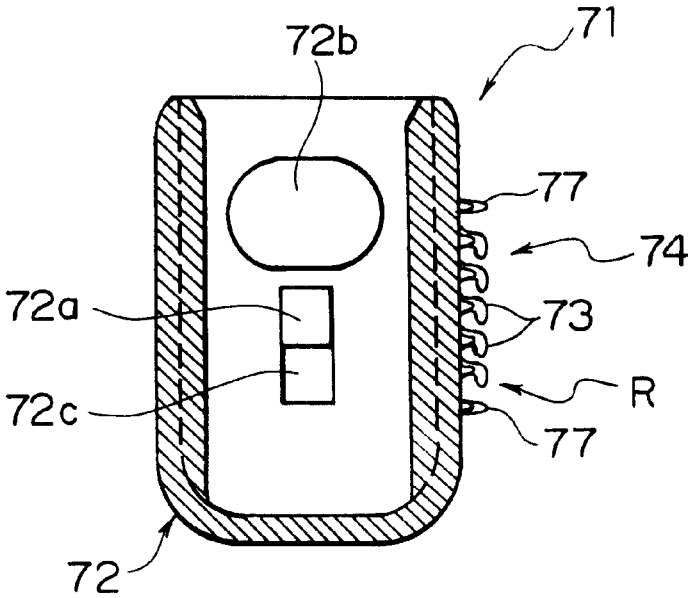
FIG. 13 is a sectional view taken along the line XIII—XIII in FIG. 12.

FIGS. 11 to 13 show a thread fixing engaging device 7 according to a fourth embodiment of the present invention. The thread fixing engaging device 7 is a fixing device for tightening and fixing a thread inserted along a peripheral portion of ski wear, quilted down coat with hood, and hem, waist, collar and hood of clothes such as half coat. In the engaging device 7 of this embodiment, its socket portion is used as a substrate 72 and a plurality of hook elements 73 are provided on part of the surface so as to protrude to form an engaging face 74. Then, this engaging device 7 is engaged directly with clothes or a mating surface fastener (not shown) mounted to a predetermined position temporarily so as to prevent the thread fixing engaging device 7 from swinging freely or being lost.

In the thread fixing engaging device 7 which is a cord stopper shown in these Figures, an inner face on the side of a bottom portion of the socket portion 72 formed in a bottomed cylindrical shape is formed with a slope 72*a*, which gradually narrows as it goes to the bottom. A pair of thread insertion holes 72*b* are formed thereabove while a pair of engaging holes 72*c* are formed below the thread insertion holes 72*b*. Then, an engaging step portion 72*d* is provided between these holes. In a plug portion 75 which can be inserted into or removed from the socket portion 72 and serves as an engaging/disengaging means of the invention, a thread insertion hole 75*a* is formed so as to pass through a head portion thereof. A pair of elastic leg pieces 75*b* are provided below the thread insertion hole 75*a* and an engaging protrusion 75*c* is provided at a tip of each leg piece 75*b*. This plug portion 75 is inserted into the socket portion 72 and then, forced into the socket portion 72 by deforming the respective elastic leg pieces 75*b* elastically deforming the respective elastic leg pieces 75*b* elastically along the slope 72*a*. With the thread insertion hole 75*a* in the plug portion 75 matching with the thread insertion hole 72*b* of the socket portion 72, a thread 76 is inserted into the thread insertion holes 72*b* and 75*a*. Then, if the pressing force to the plug portion 75 is released, the plug portion 75 is moved in such a direction that it slips out of the socket portion 72 by an action of the slope 72*a* and the elastic leg pieces 75*b*. Consequently, the thread 76 is locked by a friction generated at with corners of the respective thread insertion holes 72*b* and 75*a* so that the thread fixing engaging device 7 is fixed at any position of the thread 76.

According to this embodiment, a plurality of the hook elements 73 stands on part of the peripheral face of the socket portion 72 in the length direction thereof so as to form a hook row R and then, a plurality of the hook rows R are provided in the peripheral direction so as to form the engaging face 74. An projection 77, which is a feature of the present invention, is erected substantially vertically from the peripheral face on each of both ends of each hook row. With this projection 77 which acts as a blocking member like the above described respective embodiments, when the cord stopper 7 is operated, the finger tip is never injured by the hook element. Further, when the cord stopper is removed from clothes also, the projection 77 functions as a backup member, so that a deformation thereof by the loop element of the mating surface fastener (not shown) is suppressed thereby eliminating possibility of the hook element 73 being broken.

What is claimed is:

1. An engaging device made of synthetic resin, comprising:

a substrate including a surface having a plurality of hook elements disposed in a plurality of rows, the hook elements capable of engaging an engaging portion of a mating member having a plurality of loop elements on a surface thereof; and at least one projection being formed integrally with the engaging device and projecting substantially vertically from the substrate, the at least one projection being disposed at the end of at least one of the plurality of rows.

2. The engaging device of claim 1, wherein a height of the at least one projection in a direction substantially perpendicular to the surface is greater than the height of a bottom face of a front end of at least one of the hook elements adjacent to the at least one projection.

3. The engaging device of claim 1, wherein the mating member comprises at least one of the following: a curtain and a screen.

4. The engaging device of claim 1, further comprising a plurality of hook rows provided on the surface of the substrate and a hook-like hooking portion provided at an upper end of the substrate through a neck portion.

5. The engaging device of claim 1, further comprising:

a plurality of hook rows provided on a surface of the substrate having some degree of rigidity;

a post-like protrusion having two-wing shaped elastic engaging portions at a top end thereof provided in the center of a back face of the substrate, so that the elastic engaging portion is inserted into an engaging hole formed in a mounting body and fixed to the mounting body by engagement; and wherein the mating member is a plate-like interior material.

6. The engaging device of claim 1, wherein the mating member is clothes or various kinds of bags having a pair of opposing opening/closing edge portions, the substrate being attached to one of the opening/closing edge portions of the clothes or the various kinds of bags and having a plurality of hook rows on the surface thereof.

7. The engaging device of claim 1, wherein the mating member is clothes or various kinds of bags, the substrate being disposed in the vicinity of an opening of the clothes or the various kinds of bags and having a plurality of hook rows provided on the surface thereof, wherein the substrate has an insertion hole through which a thread is to be inserted and thread engaging/disengaging means for engaging or disengaging the thread inserted through the thread insertion hole.

* * * * *